US007779780B2

(12) United States Patent
Yoshioka et al.

(10) Patent No.: US 7,779,780 B2
(45) Date of Patent: Aug. 24, 2010

(54) LAYER FORMING APPARATUS FOR ELECTROPHOTOGRAPHIC PHOTORECEPTOR

(75) Inventors: Takashi Yoshioka, Nara (JP); Masayuki Sakamoto, Nabari (JP)

(73) Assignee: Sharp Kabushiki Kaisha, Osaka (JP)

( * ) Notice: Subject to any disclaimer, the term of this patent is extended or adjusted under 35 U.S.C. 154(b) by 724 days.

(21) Appl. No.: 11/783,535

(22) Filed: Apr. 10, 2007

(65) Prior Publication Data

US 2007/0240643 A1 Oct. 18, 2007

(30) Foreign Application Priority Data

Apr. 12, 2006 (JP) ..... P2006-110199

(51) Int. Cl.
*B05C 3/00* (2006.01)

(52) U.S. Cl. ..... 118/400; 118/423; 118/429; 118/404; 118/663

(58) Field of Classification Search ..... 118/400, 118/423, 429, 404, 603
See application file for complete search history.

(56) References Cited

U.S. PATENT DOCUMENTS 6,511,542 B2 * 1/2003 Inagaki ..... 118/404
6,921,435 B2 * 7/2005 Yasuda et al. ..... 118/423

FOREIGN PATENT DOCUMENTS

| | | | |
|---|---|---|---|
| JP | 56-117242 | A | 9/1981 |
| JP | 6-254459 | A | 9/1994 |
| JP | 9-29152 | A | 2/1997 |
| JP | 9-269604 | A | 10/1997 |
| JP | 2001-272803 | A | 10/2001 |
| JP | 2002-49162 | A | 2/2002 |
| JP | 2004-198483 | A | 7/2004 |
| JP | 2005-177656 | A | 7/2005 |

* cited by examiner

*Primary Examiner*—Parviz Hassanzadeh
*Assistant Examiner*—Albert Hilton
(74) *Attorney, Agent, or Firm*—Nixon & Vanderhye P.C.

(57) ABSTRACT

There is provided a layer forming apparatus for forming a photosensitive layer of an electrophotographic photoreceptor, containing no bubbles in a coating liquid. In the layer forming apparatus for forming the photosensitive layer of the electrophotographic photoreceptor through the dip coating method, a lower end port of a dipping cylinder is distanced away in a horizontal direction from a coating liquid discharge port, and the coating liquid discharge port is disposed above the lower end port of the dipping cylinder, in order to prevent a bubble from moving into a coating liquid portion used for actual coating even when a bubble exits in the course of circulation of the coating liquid.

8 Claims, 8 Drawing Sheets

LAYER FORMING APPARATUS FOR ELECTROPHOTOGRAPHIC PHOTORECEPTOR

CROSS-REFERENCE TO RELATED APPLICATION

This application claims priority to Japanese Patent Application No. 2006-110199, which was filed on Apr. 12, 2006, the contents of which, are incorporated herein by reference, in their entirety.

BACKGROUND

1. Field of the Technology

The technology presented herein relates to a layer forming apparatus for forming at least one layer of photosensitive layers of an electrophotographic photoreceptor by a dip coating method.

2. Description of the Related Art

In the art of electrophotography, image formation is carried out in the following manner. A surface of an electrophotographic photoreceptor (hereinafter referred to as "a photoreceptor") is charged and then exposed to light so that an electrostatic latent image is formed. The electrostatic latent image is then developed by electrostatically depositing a toner on the surface of the photoreceptor on which a latent image is formed. A toner image is thus obtained and then transferred from the surface of the photoreceptor to a recording medium such as paper, and the toner image on the recording medium is fixed afterward. In forming the image, the toner is charged by frictional electrification and transported by a developer carrier such as a developing roller so that the toner is supplied to the surface of the photoreceptor. Residual toner, which is not transferred to the recording medium and remains on the surface of the photoreceptor, is physically scrapped off by a removing section and thus removed from the surface of the photoreceptor.

The photoreceptors in practical use at present may be classified roughly into photoreceptors using inorganic material and photoreceptors using organic material. The photoreceptors using inorganic material include photoreceptors using a selenium-series material such as amorphous selenium (a-Se) and amorphous arsenic selenium (a-$As_2Se_3$); and photoreceptors in which amorphous silicone (a-Si) and dye-sensitized zinc oxide (ZnO) are dispersed in binder resin. Further, the photoreceptors using organic material include a photoreceptor prepared by dispersing in polycarbonate resin or the like ingredient a phthalocyanine pigment or the like ingredient as a charge generating material and a hydrazone- or butadiene-series compound or the like ingredient as a charge transporting material.

Compared to the photoreceptors using inorganic material, the photoreceptors using organic material are higher in electrophotographic property, free from toxicity, and lower in manufacturing cost, by virtue of their applicability of a larger number of materials in various combinations.

As a method of manufacturing the photoreceptors using organic material (a method of forming a photosensitive layer), a dip coating method is generally adopted from the perspective of its relatively simple configuration of the apparatus and excellent productivity. In the dip coating method, a photosensitive layer is formed in a manner that a conductive substrate is dipped into a coating liquid (a photosensitive solution) containing a photosensitive substance, and then pulled up, followed by drying.

As described above, the dip coating method provides a relatively simple technique of production and enables to obtain a plurality of photoreceptors at one time. The dip coating method is thus suitable for mass production. However, such a dip coating method requires a large quantity of photosensitive solution in a coating tank, a pipe, etc. where a large amount of the photosensitive solution is not actually used and therefore remains. This poses a cost problem in small-lot production of various kinds. As a result, the study has started about how to reduce the coating liquid.

Moreover, in connection with the use of an organic solvent in the photosensitive solution, the organic solvent is added for adjustment of viscosity of the photosensitive solution since the organic solvent is liable to evaporate, and the photosensitive solution is circulated in order to collect for reuse the photosensitive solution which has overflowed at the coating occasion. In the circulation, a bubble is easily generated, thus inducing the study for various bubble-removing devices.

In a coating apparatus used for electrophotographic photoreceptor disclosed in Japanese Unexamined Patent Publication JP-A 9-269604 (1997), a deaeration mechanism for the overflowed coating liquid is provided just before a storage tank. However, the bubble arising in the coating liquid at the coating occasion is not taken into consideration although the bubble is generated from piping and liquid-supply pump of circulatory system.

In a coating apparatus used for electrophotographic photoreceptor disclosed in Japanese Unexamined Patent Publication JP-A 2001-272803, a centrifugal bubble-removing separator is provided between a liquid-supply pump and a coating tank. However, also in this case, the bubble is assumed to arise when the overflowed coating liquid is moving back, and the bubble arising on the downstream of the centrifugal bubble-removing separator is thus not taken into consideration.

Furthermore, in a non-sealed coating system, a smaller amount of the coating liquid in total will cause a relatively frequent contact of the coating liquid with the air, and a larger supply amount of the coating liquid will cause the air to be easily caught therein. Neither of JP-A 9-269604 and JP-A 2001-272803 disclose any approaches to the case where the total amount of the coating liquid is small.

SUMMARY

In view of problems as described above, a feature of an example embodiment presented herein is to provide a layer forming apparatus in which, even when a bubble is generated in the course of liquid supply, the bubble is not delivered into a dipping cylinder so that a photosensitive layer containing no film defects is formed.

The example embodiment provides a layer forming apparatus for electrophotographic photoreceptor, comprising:

a coating tank having a bath for storing a coating liquid; a dipping cylinder having a lower end port thereof dipped in the coating liquid; and a coating liquid discharge port for discharging the coating liquid supplied from a liquid-supply pump to the bath, wherein at least one layer of photosensitive layers of an electrophotographic photoreceptor is formed by a dip coating method, and wherein a lower end port of the dipping cylinder is distanced away in a horizontal direction from the coating liquid discharge port, and the coating liquid discharge port is disposed above the lower end port of the dipping cylinder.

According to the example embodiment, a layer forming apparatus for electrophotographic photoreceptor comprises a coating tank having: a bath for storing a coating liquid; a dipping cylinder having a lower end port thereof dipped in the coating liquid; and a coating liquid discharge port for discharging the coating liquid supplied from a liquid-supply pump to the bath, which layer forming apparatus forms at least one layer of photosensitive layers of an electrophotographic photoreceptor through a dip coating method. A lower end port of the dipping cylinder is distanced away in a horizontal direction from the coating liquid discharge port, and the coating liquid discharge port is disposed above the lower end port of the dipping cylinder. Thus, the bubble does not move into the dipping cylinder by virtue of such a layout that the lower end port of the dipping cylinder is distanced away in the horizontal direction from the coating liquid discharge port, and the coating liquid discharge port is disposed above the lower end port of the dipping cylinder for substrate. Accordingly, by using the layer forming apparatus of the invention in which the bubble does not move into the dipping cylinder even when the bubble is generated in the coating liquid, it is possible to obtain a fine electrophotographic photoreceptor which is free from film defects. The adoption of the electrophotographic photoreceptor in an electrophotographic device causes no image defects to appear, allowing a high-quality image to be procured.

Further, in the example embodiment, it is preferable that a distance in a vertical direction between the coating liquid discharge port and the lower end port of the dipping cylinder is 5 mm or more.

According to the example embodiment, the coating liquid discharge port and the lower end port of the dipping cylinder are distanced away from each other by 5 mm or longer when seen in the vertical direction. Thus, even when the coating liquid containing a bubble is supplied from the coating liquid discharge port, the bubble stays outside of the dipping cylinder and does not move into the dipping cylinder by virtue of the difference of 5 mm or more in height between the coating liquid discharge port and the lower end port of the dipping cylinder. This makes it possible to obtain a favorable photosensitive layer that no bubbles are contained in a substrate which is to be coated with the coating liquid.

Further, in the example embodiment, it is preferable that the layer forming apparatus further comprises:

a coating liquid supply port for supplying the coating liquid to the coating liquid discharge port; and a dispersion plate which is platy and disposed above the coating liquid supply port and in which the coating liquid discharge port is formed.

According to the example embodiment, the layer forming apparatus further comprises a coating liquid supply port for supplying the coating liquid to the coating liquid discharge port; and a dispersion plate which is platy and disposed above the coating liquid supply port and in which the coating liquid discharge port is formed. The coating liquid supplied from the coating liquid supply port can be thus dispersed in a radial pattern. For example, in the case where a large number of the coating liquid discharge ports are formed, the coating liquid is dispersed to be discharged from the respective coating liquid discharge ports. This enables to adapt the layer forming apparatus to obtain a plurality of photoreceptors at one time through coating in the dipping cylinders.

Further, in the example embodiment, it is preferable that the dispersion plate is provided with a liquid-dispersing convex portion having a tapered shape at a position located above the coating liquid supply port.

According to the example embodiment, the dispersion plate is provided with a liquid-dispersing convex portion having a tapered shape at a position located above the coating liquid supply port. The tapered portion of the dispersion plate positioned above the coating liquid supply port smoothens the dispersion of the coating liquid. Moreover, a larger area for the coating liquid to collide with decreases the mutual collision of liquid which causes a bubble, resulting in suppressed generation of the bubble.

Further, in the example embodiment, it is preferable that the coating tank comprises a lower tank having the bath and an upper tank positioned above the lower tank, the lower tank and the upper tank being separable.

According to the example embodiment, the coating tank comprises a lower tank having the bath and an upper tank positioned above the lower tank, and the lower tank and the upper tank are separable. This can lead not only facilitation of cleaning and maintenance but also reduction in length of working hours relating to the exchange of the coating liquid.

Further, in the example embodiment, it is preferable that an upper part of the bath is formed into a tapered shape, and an apex of the bath is provided with a bubble-removing tube for discharging a bubble.

According to the example embodiment, outside the dipping cylinder, the bath is formed inside the coating tank, an upper part of the bath is formed into a tapered shape, and an apex of the bath is provided with a bubble-removing tube for discharging a bubble. The bubble can thus move upward along a sloping surface of the upper tapered portion to be then discharged reliably from the bubble-removing tube. Moreover, no accumulation of bubble will prevent the bubble from moving into the dipping cylinder.

Further, in the example embodiment, it is preferable that the coating liquid is a coating liquid for charge transporting layer.

According to the example embodiment, the coating liquid is a coating liquid for charge transporting layer. This makes it possible to easily remove a bubble also contained in the coating liquid for charge transporting layer in which a bubble is more liable to be generated compared to the coating liquid for undercoat layer and the coating liquid for charge generating layer.

Further, the example embodiment provides a layer forming system comprising:

the layer forming apparatus for electrophotographic photoreceptor; and a circulation device having at least a circulation passage for circulating a coating liquid stored in a bath, and a liquid-supply pump for supplying the coating liquid through the circulation passage.

According to the example embodiment, a layer forming system comprises the layer forming apparatus for electrophotographic photoreceptor, and a circulation device. The circulation device has at least a circulation passage for circulating a coating liquid stored in a bath, and a liquid-supply pump for supplying the coating liquid through the circulation passage. It is thus possible to constitute the layer forming system composed of the layer forming apparatus for electrophotographic photoreceptor, and the circulation device.

BRIEF DESCRIPTION OF THE DRAWINGS

Other and further features, and advantages of the example embodiment will be more explicit from the following detailed description taken with reference to the drawings wherein.

DETAILED DESCRIPTION

Figure 1:
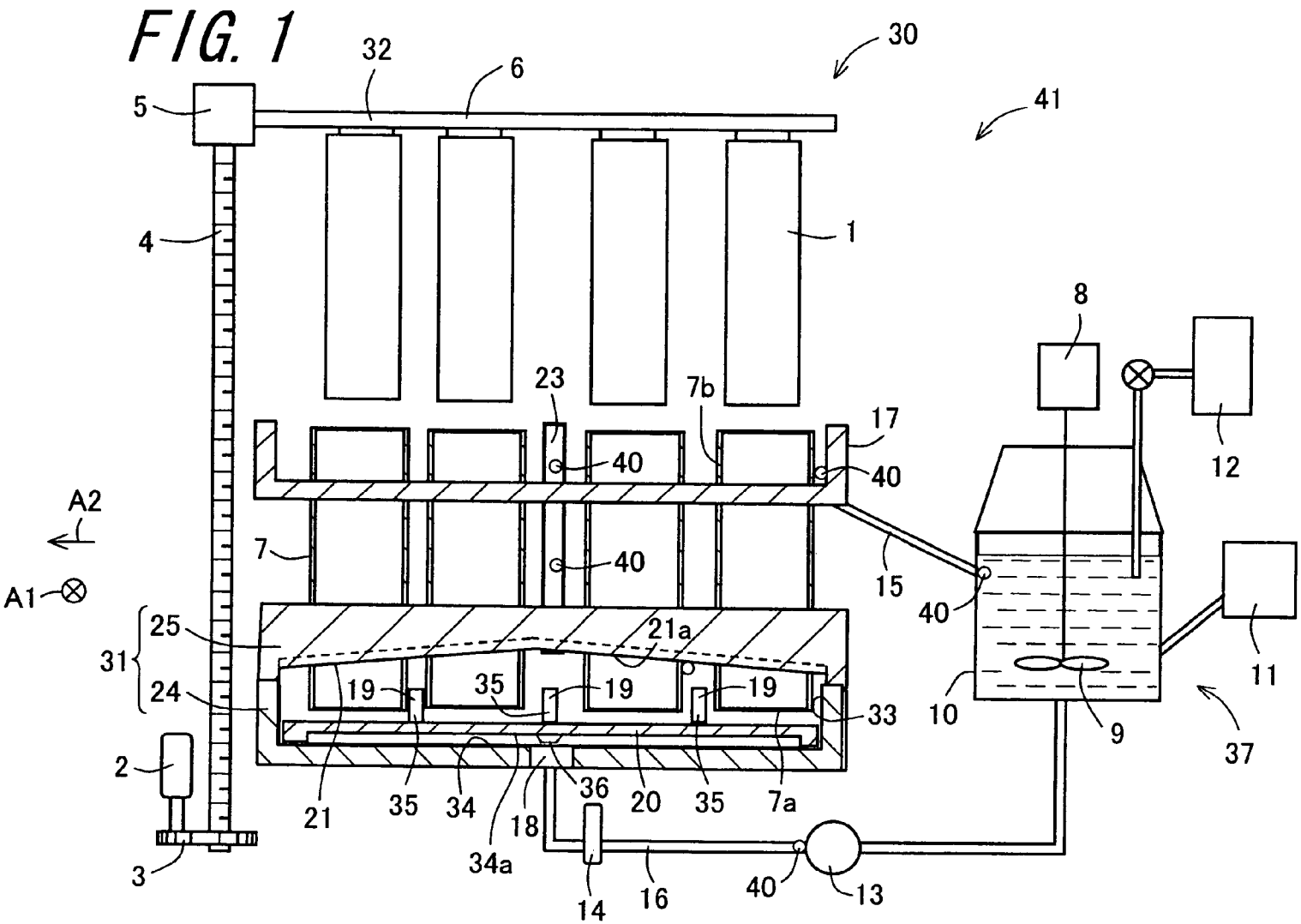
FIG. 1 is a schematic view showing a layer forming system according to a first embodiment.

Now referring to the drawings, preferred embodiments are described below.

Figure 2:
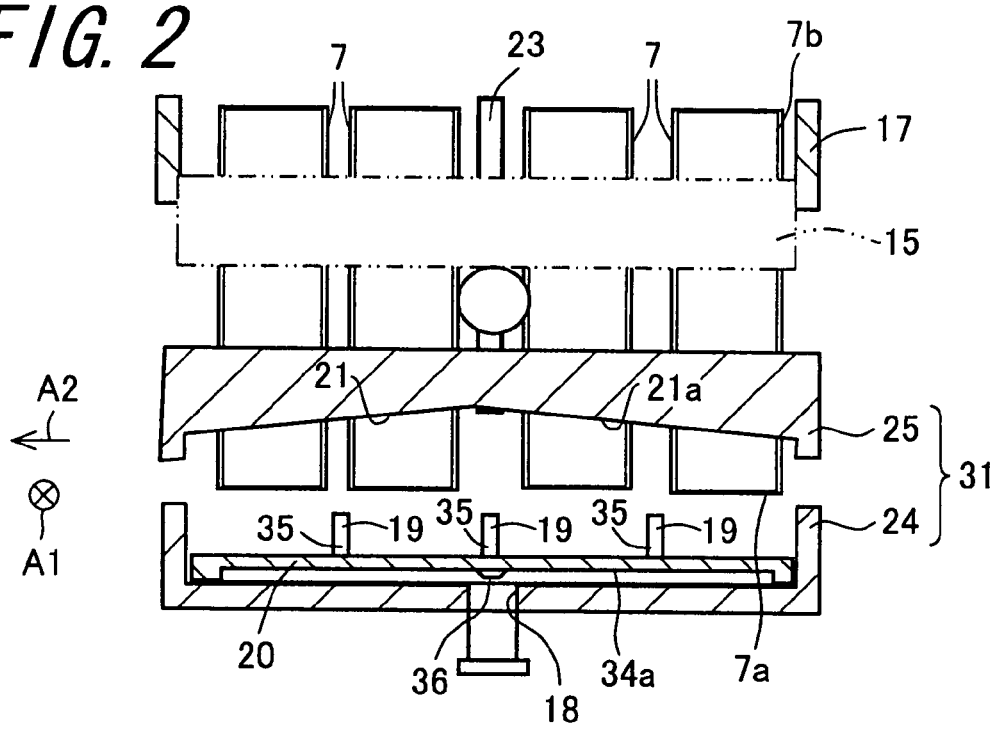
FIG. 2 is a sectional front view separately showing an upper tank and a lower tank of one coating tank according to the embodiment.
Figure 3:
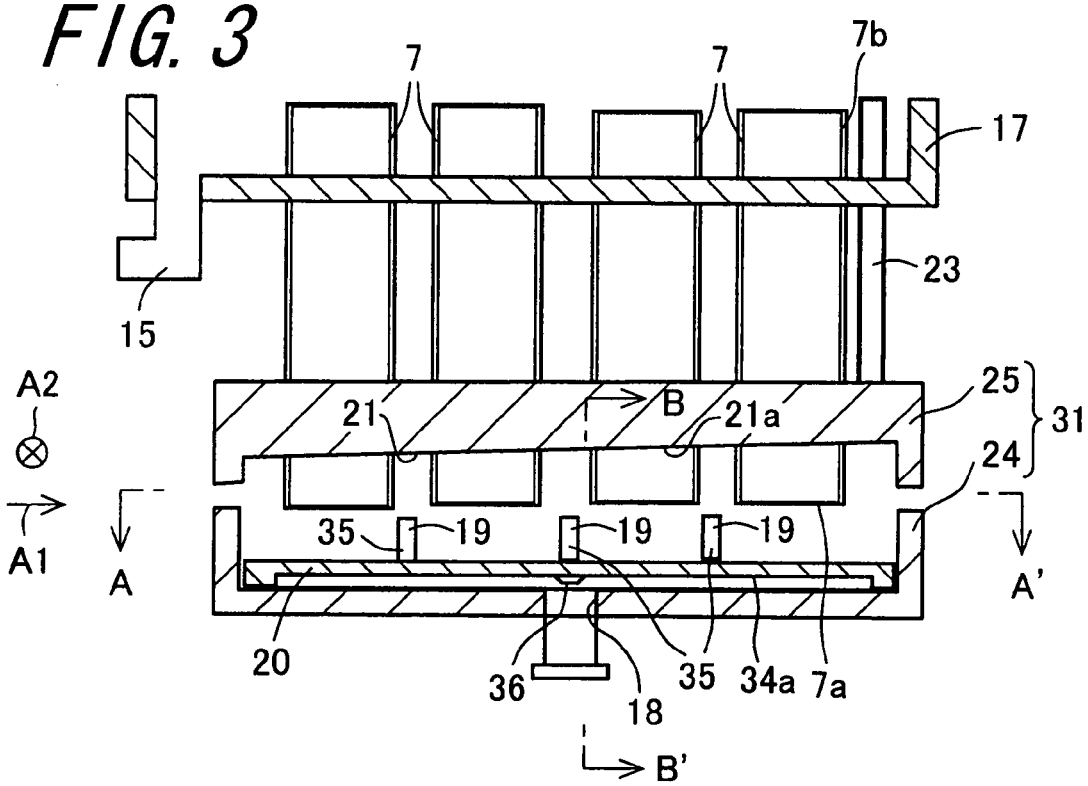
FIG. 3 is a sectional side view separately showing the upper tank and the lower tank of the one coating tank according to the embodiment.
Figure 4:
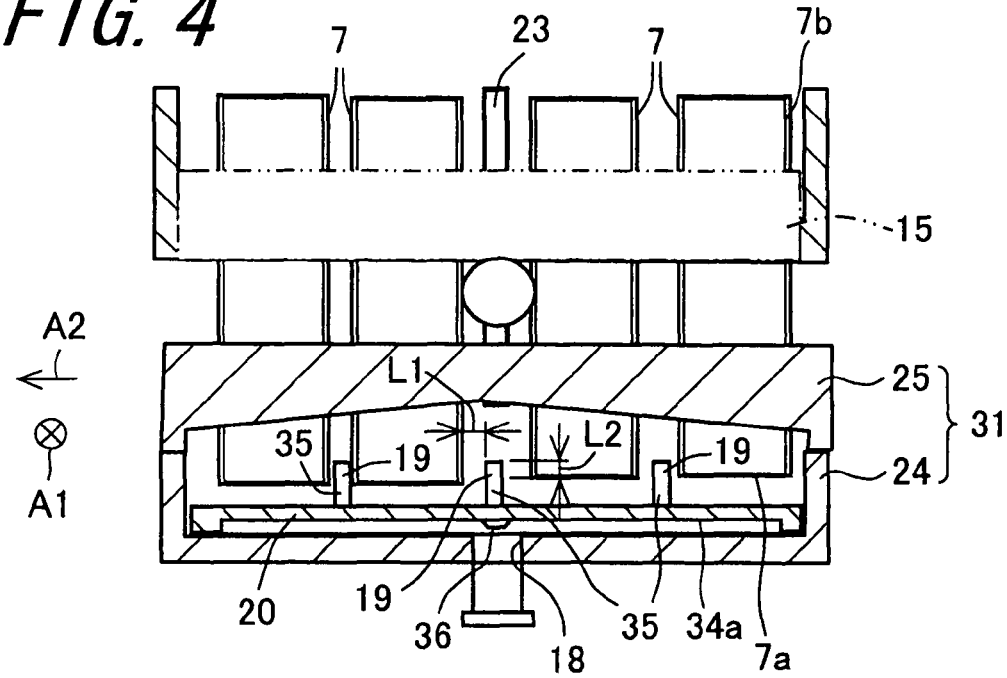
FIG. 4 is a sectional front view showing one coating tank according to the embodiment.
Figure 5:
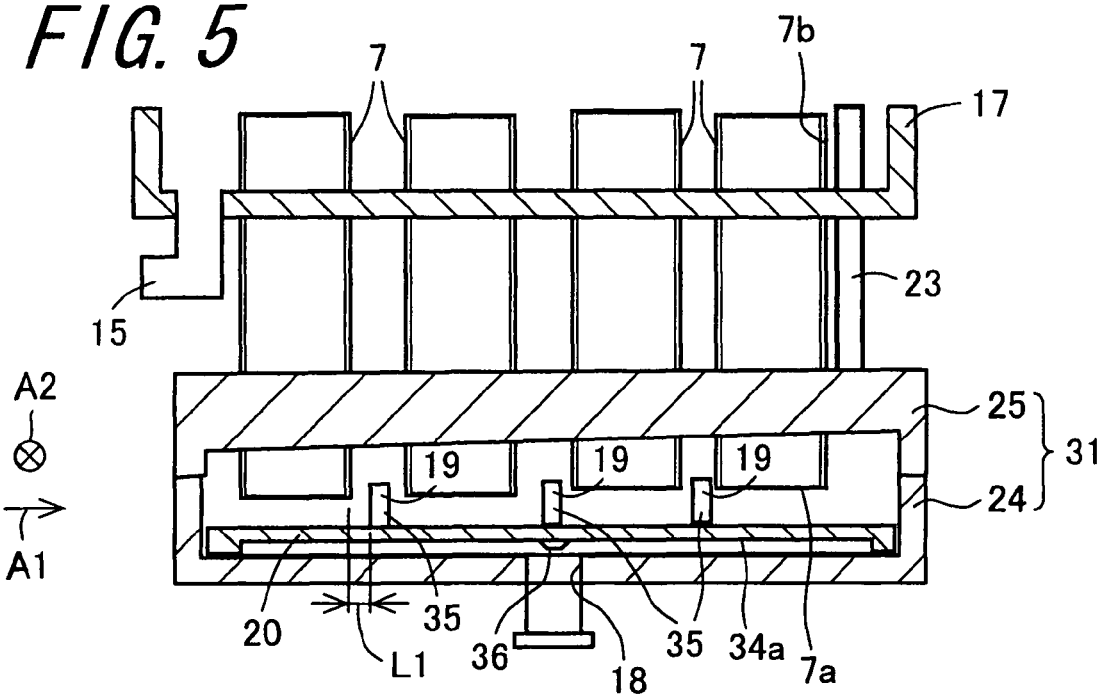
FIG. 5 is a sectional side view showing the one coating tank according to the embodiment.

FIG. 1 is a schematic view showing a layer forming system 41 according to a first embodiment of the invention. FIG. 2 is a sectional front view separately showing an upper tank 25 and a lower tank 24 of one coating tank according to an embodiment. FIG. 3 is a sectional side view separately showing the upper tank 25 and the lower tank 24 of the one coating tank according to the embodiment. FIG. 4 is a sectional front view showing one coating tank 36 according to the embodiment. FIG. 5 is a sectional side view showing the one coating tank 36 according to the embodiment. The layer forming system 41 for forming a photosensitive layer of an electrophotographic photoreceptor according to the first embodiment of the invention includes a layer forming apparatus 30 and a circulation device 37. The layer forming apparatus 30 has at least a plurality of dipping cylinders 7, a dipping bath 31, and a dipping device 32. The layer forming apparatus 30 is connected to a liquid-supply pump 13, a return piping 15, and a supply piping 16. In the layer forming system 41, a prepared coating liquid is supplied from the circulation device 37 to the layer forming apparatus 30, and a cylindrical substrate 1 is dipped by the dipping device 32 into the dipping cylinder 7 filled with the supplied coating liquid, to thereby coat the cylindrical substrate 1 with the coating liquid, so that the photosensitive layer of the electrophotographic photoreceptor is formed.

The dipping tank 31 has a space 33 formed therein which is filled with the coating liquid. The dipping tank 31 has the lower tank 24 and the upper tank 25 which are coupled to each other. The lower tank 24 and the upper tank 25 are sealed each other with a leak proof mechanism formed of a sealing member or the like (not shown). An inner wall portion on an upper side of the dipping tank 31 is formed so that a section thereof has a tapered, more specifically a V-shaped profile line, which section is seen in a first direction A1 perpendicular to an up-and-down (vertical) direction among sections cut by a plane along the up-and-down direction. When the inner wall portion on the upper side of the dipping tank 31 is cut in a second direction A2 that is perpendicular to the up-and-down direction and is perpendicular to the first direction A1, a profile line of the section thus formed is inclined upward from one end to the other end in the first direction A1. The dipping tank 31 is provided with the plurality of the dipping cylinders 7.

The dipping cylinder 7 is formed into a cylindrical shape with both ends in an axial direction thereof opened. An axiswise lower end port 7*a* of the dipping cylinder 7 is disposed inside the dipping tank 31 and dipped in the coating liquid inside the space 33. The dipping cylinder 7 is thus filled up with the coating liquid. An upper end portion 7*b* of the dipping cylinder 7 is provided with an overflowing coating liquid receiver 17.

The overflowing coating liquid receiver 17 is a pan for receiving and storing the coating liquid which overflows from the upper end portion 7*b* of the dipping cylinder 7, and provided with the return piping 15. The return piping 15 is a piping for coupling the overflowing coating liquid receiver 17 and a stirring tank 10 to each other. In the return piping 15 is formed a flow channel for moving the coating liquid stored in the overflowing coating liquid receiver 17 back to the stirring tank 10.

The stirring tank 10 is a tank for storing a liquid, and provided with a stirrer 8 for stirring the stored liquid by use of a stirring blade 9. To the stirring tank 10, the coating liquid comes back from the overflowing coating liquid receiver 17 by way of the return piping 15, the solvent is supplied from a solvent supply section 12, and the coating agent is supplied from a coating agent supply section 11. Those coating agent and solvent are stirred by the stirrer 8 in the stirring tank 10. The stirring tank 10 is provided with the supply piping 16. The supply piping 16 is a piping for coupling the stirring tank 10 and the dipping tank 31 to each other. In the supply piping 16 is formed a flow channel for supplying the liquid, that is, specifically the coating liquid, stored inside the stirring tank 10 to the dipping tank 31. The supply piping 16 continues into a coating liquid supply port 18 formed in the dipping tank 31, through which coating liquid supply port 18 the coating liquid is supplied to the space 33. The supply piping 16 has the liquid-supply pump 13 and a filter 14 interposed therein. The liquid-supply pump 13 is configured so as to supply the coating liquid from the stirring tank 10 to the dipping tank 31. The filter 14 has a function of removing foreign substances, and is disposed downstream in a liquid-supply direction of the liquid-supply pump 13.

Furthermore, a dispersion plate 20 is disposed inside the dipping tank 31, that is, inside the space 33. The dispersion plate 20 is a plate body extending in a horizontal direction, and disposed inside the space 33 so as to divide the space 33 into an upper part and a lower part. The dispersion plate 20 forming the upper part of the space 33 and the inner wall portion of the dipping tank 31 are referred to as a bath 21. Further, the lower part of the space 33 is referred to as a dispersion flow channel 34. In the dispersion plate 20 are formed a plurality of cylindrical coating liquid discharge cylinders 35. The coating liquid in the dispersion flow channel 34 is discharged from a coating liquid discharge port 19 which is an upper end port of the coating liquid discharge cylinder 35, to the bath 21 by way of the coating liquid discharge cylinders 35. The respective coating liquid discharge ports 19 are formed away in a horizontal direction relative to the lower end ports 7*a* of a plurality of the dipping cylinders 7, and formed above the lower end ports 7*a* of the plurality of the dipping cylinders 7.

Furthermore, in the dispersion plate 20, a liquid-dispersing convex portion 36 is formed on a surface portion 34*a* facing the dispersion flow channel 34. The liquid-dispersing convex portion 36 protrudes in a direction away from the surface portion 34*a*, to be specific, downward. The liquid-dispersing convex portion 36 is disposed above the coating liquid supply port 18, and has side face portions thereof in the first direction A1 and second direction A2 formed into a tapered shape. To explain it more specifically, the liquid-dispersing convex portion 36 is disposed at a position with which the coating liquid discharged from the coating liquid supply port 18 collides, and the respective side face portions of the liquid-dispersing convex portion 36 are formed into a tapered shape so that the collided coating liquid is dispersed in the dispersion flow channel 34 in a substantially even manner.

On an apex of an upper portion of the dipping tank 31, that is, an apex of an upper portion (hereinafter referred to as a tapered portion) 21*a* of the bath 21, a bubble-removing tube 23 is formed. The bubble-removing tube 23 is formed into a cylindrical shape, with one end and the other end in an axial direction thereof opened. The bubble-removing tube 23 is disposed so that the one end in the axial direction of bubble-removing tube 23 faces the space 33 while the other end in the axial direction of bubble-removing tube 23 forms an identical plane with an upper end of the overflowing coating liquid receiver 17. The bubble-removing tube 23 is a tube for causing a bubble contained in the coating liquid in the bath 21, to be released from the bath 21 to outside.

The dipping device 32 is a device for dipping the cylindrical substrate 1 into the dipping cylinder 7. The dipping device 32 is a so-called linear servo mechanism, and provided with a motor 2, a gear train 3, a ball screw 4, and a support 6 having a nut member 5. The motor 2 is configured so as to be capable of rotating the ball screw 4 via the gear train 3. The support 6 is configured so as to be displaceable in a vertical direction through the rotation of the ball screw 4 into which the nut 5 is screwed. The support 6 is configured so as to grasp the cylindrical substrate 1 by using a chucking portion.

The configuration containing the bath 21, the dipping cylinder 7, and the coating liquid discharge port 19 corresponds to the coating tank.

While the support 6 provided with the chucking portion (not shown) keeps grasping the cylindrical substrate 1 which is a to-be-coated object, the cylindrical substrate 1 is made to move downward, by use of the rotation of the motor 2, into the dipping cylinder 7 filled with the coating liquid until the upper end portion of the cylindrical substrate 1 is dipped into the coating liquid. Subsequently, the motor 2 is rotated inversely so that the cylindrical substrate 1 is pulled up at a predetermined speed. By so doing, a wet photosensitive layer is formed on a surface of the cylindrical substrate 1 and then, the organic solvent contained in the coating liquid is evaporated, followed by heating and drying. The photosensitive layer can be thus obtained.

Next, descriptions will be given to the flow of bubble in the coating liquid. A bubble 40 is generated in the coating liquid at occasions of, for example, the liquid supply effected by the liquid-supply pump 13, the stirring inside the stirring tank 10, and the circulation of the coating liquid inside the supply piping 16. To take an example, the flow of the bubble 40 generated by the liquid-supply pump 13 will be described as follows. The bubble 40 contained in the coating liquid passes through the supply piping 16 and the filter 14 for removing foreign or impure substances, to then reach the coating liquid supply port 18.

Afterward, the coating liquid collides with the dispersion plate 20 and is thus dispersed in a radial pattern, followed by being delivered into the bath 21 through the coating liquid discharge port 19. Subsequently, the bubble 40 moves upward in the bath 21 to reach the tapered portion 21*a*, and then move along the tapered portion 21*a* toward the apex of the tapered portion 21*a*.

The bubble 40 moves upward in the bubble-removing tube 23 for discharging the bubble 40, which is formed on the apex of the tapered portion 21*a*, to be then discharged from an upper end portion of the bubble-removing tube 23.

When the bubble 40 is being discharged, the bubble 40 frequently comes into contact with the atmosphere, that is to say, the bubble 40 is frequently open to the atmosphere, which causes the bubble 40 to be released into the atmosphere and thus disappear. In the case where the bubble 40 is not released into the atmosphere and thus does not disappear, the bubble 40 remains in the overflowing coating liquid receiver 17. And the coating liquid containing the bubble 40 returns to the stirring tank 10 by way of the return piping 15. This will result in the circulation of the coating liquid containing the bubble 40 in the circulatory system composed of the supply piping 16, the bath 21, the bubble-removing tube 23, and the stirring tank 10.

Next, with reference to FIGS. 2 and 3, description will be given to the method of removing a bubble in the coating liquid in the layer forming apparatus 30 used for electrophotographic photoreceptor characterized by the invention. The layer forming apparatus 30 according to the present embodiment is composed of the lower tank 24 for storing the coating liquid and the upper tank 25 having the dipping cylinder 7, the tapered portion 21*a*, the bubble-removing tube 23, etc. as shown in FIG. 2.

Upon the layer formation in practice by use of the coating liquid, the upper tank 25 and the lower tank 24 in use are integrated with each other as shown in FIG. 3 while the leak proof mechanism (not shown) is added to the connection part between the upper tank 25 and the lower tank 24 in order to prevent the liquid from leaking.

The tapered portion 21*a* may be formed into a quadrangular pyramid of which apex is a center portion in the A1 direction and A2 direction and in which the bubble 40 is collected in the center portion of the bath 21 having the bubble-removing tube 23 disposed thereon, thus removing the bubble 40.

Figure 6:
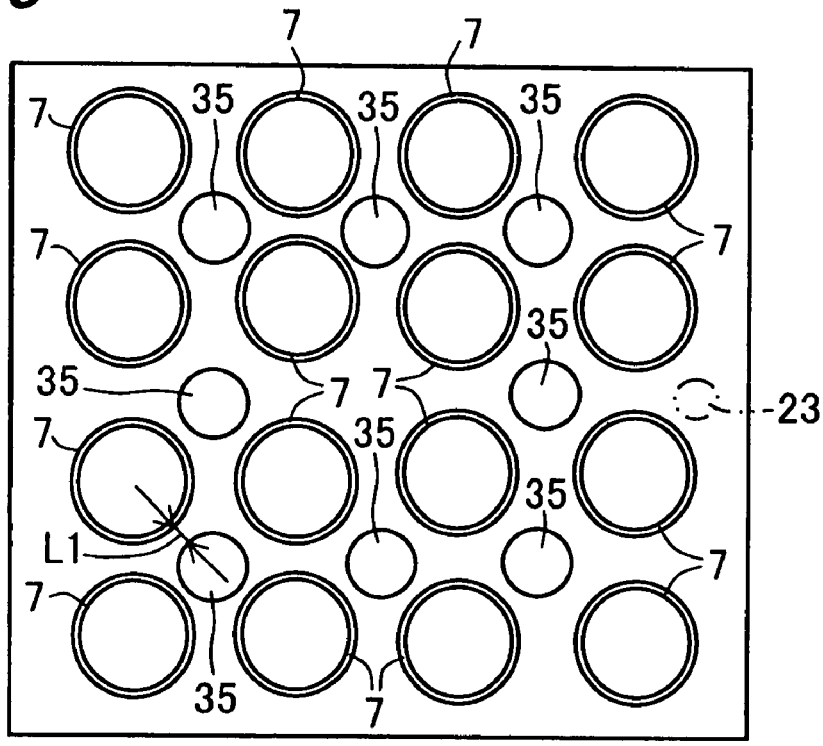
FIG. 6 is a sectional view taken on line A-A' of FIG. 3.

FIG. 6 is a sectional view taken on line A-A' of FIG. 3. As shown in FIG. 6, there are 16 dipping cylinders 7 having an outer diameter of 95 mm, 8 coating liquid discharge ports 19 having an outer diameter of 8 mm, and one bubble-removing tube 23. In the case, the dipping cylinders 7 and the coating liquid discharge ports 19 need to be disposed so as not to overlap each other when projected on a virtual plane perpendicular to the vertical direction, for the purpose of preventing the bubble 40 contained in the coating liquid from moving directly into the dipping cylinder 7. To be specific, the dipping cylinder 7 and the coating liquid discharge port 19 are disposed away from each other by a horizontally-spaced distance L1 which is preferably 15 to 70 mm and more preferably 20 to 60 mm.

Figure 7:
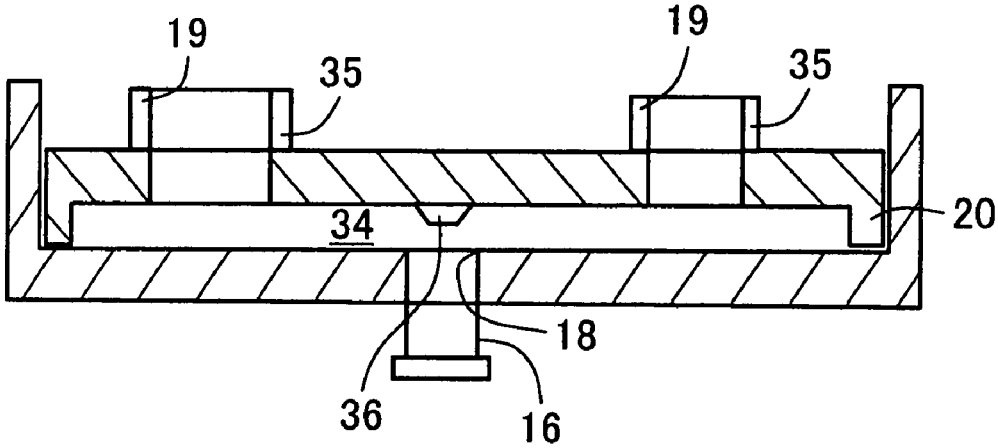
FIG. 7 is a sectional view taken on line B-B' of FIG. 3.
Figure 8:
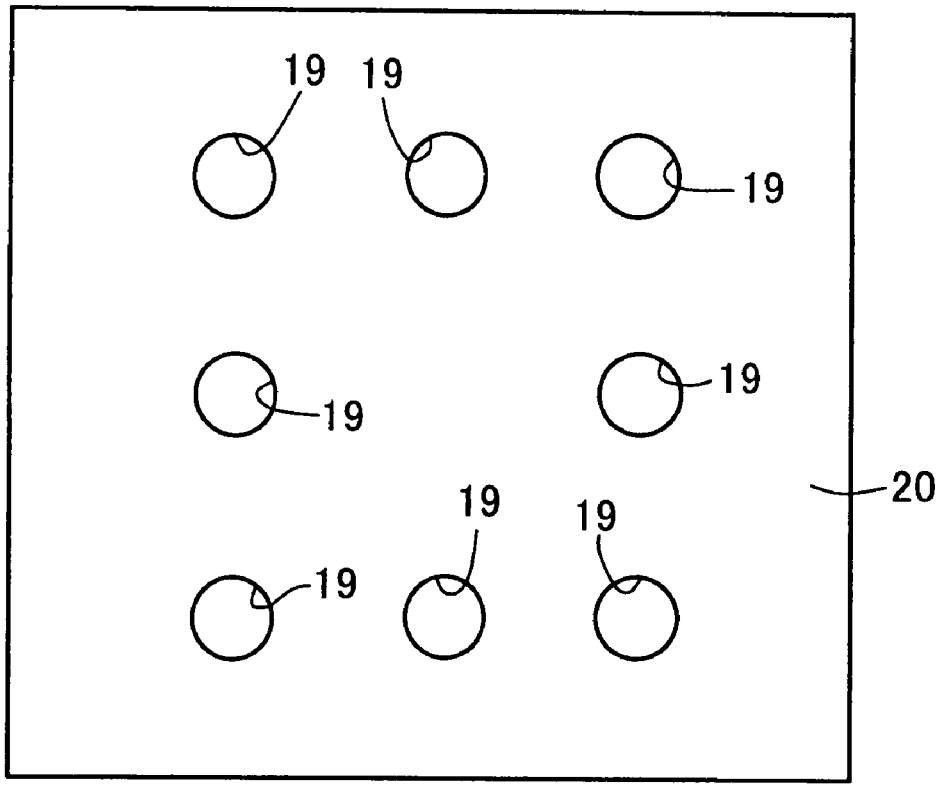
FIG. 8 is a plan view showing a dispersion plate.

FIG. 7 is a sectional view taken on line B-B' of FIG. 3. FIG. 8 is a plan view showing the dispersion plate 20. As shown in FIGS. 3 and 7, the coating liquid discharge port 19 is disposed above the lower end port of the dipping cylinder 7. The arrangement aims to prevent the bubble 40 contained in the coating liquid from moving into the dipping cylinder 7. A distance in the vertical direction between the coating liquid discharge port 19 and the lower end port of the dipping cylinder 7 is defined by a distance L2 which is different depending on a kind of the coating liquid in use. To be specific, the bubble 40 is reliably prevented form moving into the dipping cylinder 7 by ensuring the distance L2 to be 3 mm or longer for the coating liquid used for undercoat layer, 1 mm or longer for the coating liquid used for charge generating layer, and 5 mm or longer for the coating liquid used for charge transporting layer.

In the layer forming apparatus 30 for electrophotographic photoreceptor according to the first embodiment of the invention, when the dispersion plate 20 is formed into a structure in which the coating liquid discharge port 19 is disposed above the lower end port of the dipping cylinder 7 by 5 mm or longer, such a dispersion plate 20 can be used for all of the undercoat layer, the charge generating layer, and the charge transporting layer.

[Configuration of Photosensitive Layer and Materials of Coating Liquid used for the Photosensitive Layer]

An undercoat layer is often provided between the cylindrical substrate 1 and the charge generating layer for the purpose of, for example, covering flaws and irregularities of the cylindrical substrate 1, preventing pinholes from being formed, preventing a charging property from decreasing in repetitive use, enhancing a charging characteristic in an environment of low temperature and low humidity, enhancing the charging property, preventing an unnecessary charge from being injected from the substrate, or enhancing adhesiveness of the photosensitive layer.

As resin used for undercoat layer, it is possible to use resin such as polyamide, copolymer nylon, polyvinyl alcohol, polyurethane, polyester, epoxy, phenol resin, casein, cellulose, or gelatin. In particular, alcohol-soluble copolymer nylon is frequently used. Further, as appropriate, the resin may contain inorganic pigments such as zinc oxide, titanium oxide, tin oxide, indium oxide, silica, and antimony oxide, which are dispersed in the resin by use of a dispersing machine including a ball mill, a dyno-mill, and an ultrasound oscillating machine, for the purpose of setting the volume resistivity of the undercoat layer, enhancing the repetitive aging property in an environment of low temperature and low humidity, and attaining other effects.

The coating liquid for undercoat layer is prepared by, to begin with, dispersing the above-stated resin and inorganic pigments in water or other various organic solvents. In particular, preferably used are a single solvent consisting of one of water, methanol, ethanol, and butanol; a combined solvent consisting of water and alcohols or of two or more alcohols; and a combined solvent consisting of alcohols and chlorinated solvents such as dichloroethane, chloroform, trichloroethane, trichloroethylene, or perchloroethylene. The ratio of the inorganic pigments in the undercoat layer is appropriately 30% to 95% by weight.

The charge generating layer contains as a major component the charge generating substance which generates charges when exposed to light. As appropriate, the charge generating layer may contain a binder, a plasticizer, a sensitizer, and other ingredients.

The usable charge generating substance includes, for example: perylene pigments such as perylene imide and perylenic anhydride; polycyclic quinone pigments such as quinacridone and anthraquinone; phthalocyanine pigments such as metal or metal-free phthalocyanine and halogenated metal-free phthalocyanine; a squarium dye; an azulenium dye; a thiapyrylium dye; or azo pigments having a carbazole skeleton, a styryl stilbene skeleton, a triphenylamine skeleton, a dibenzothiophene skeleton, an oxadiazole skeleton, a fluorenone skeleton, a bis-stilbene skeleton, a distyryl oxadiazole skeleton, or a distyryl carbazole skeleton. Examples of the pigment having a particularly high charge generating performance are a metal-free phthalocyanine pigment, an oxotitanyl phthalocyanine pigment, a bisazo pigment containing a fluorene ring and a fluorenone ring, and a trisazo pigment containing aromatic amine.

Examples of the binder used in the charge generating layer include melamine resin, epoxy resin, silicon resin, polyurethane resin, acrylic resin, vinyl chloride-vinyl acetate copolymer resin, polycarbonate resin, phenoxy resin, polyvinyl butyral resin, polyarylate resin, polyamide resin, or polyester resin.

The coating liquid for charge generating layer is prepared by dissolving the above-state binder in a solvent and then dispersing the charge generating substance in the solvent. The usable solvent includes, for example: ketones such as acetone, methyl ethyl ketone, and cyclohexanone; esters such as ethyl acetate and butyl acetate; ethers such as tetrahydrofuran and dioxane; aromatic hydrocarbons such as benzene, toluene, and xylene; and polar aprotic solvents such as N,N-dimethylformamide and dimethylsulfoxide. The ratio of the charge generating substances in the charge generating layer is preferably 30% to 90% by weight.

The charge transporting layer is provided on the charge generating layer. The charge transporting layer contains as essential components the charge transporting substance which is capable of receiving the charge generated by the charge generating substance and then transporting the charge; binder; and a leveling agent for preventing orange peels. Further, the charge transporting layer may contain a plasticizer, a sensitizer, and other ingredients as appropriate.

Examples of the charge transporting substance include electron-donating substances such as poly-N-vinylcarbazole and a derivative thereof, poly-γ-carbazolylethylglutamate and a derivative thereof, pyrene-formaldehyde condensate and a derivative thereof, polyvinylpyrene, polyvinyl phenanthrene, an oxazole derivative, an oxadiazole derivative, an imidazole derivative, 9-(p-diethylaminostyryl)anthracene, 1,1-bis(4-dibenzylaminophenyl)propane, styryl anthracene, styryl pyrazoline, a pyrazoline derivative, phenyl hydrazones, a hydrazone derivative, a triphenylamine compound, a triphenylmethane compound, a stilbene compound, an azine compound having a 3-methyl-2-benzothiazoline ring; and electron-accepting substances such as a fluorenone derivative, a dibenzothiophene derivative, an indenothiophene derivative, a phenanthrenequinone derivative, an indenopyridine derivative, a thioxanthone derivative, a benzo[c]cinnoline derivative, a phenazine oxide derivative, tetracyanoethylene, tetracyanoquinodimethane, bromanyl, chloranil, and benzoquinone.

As the binder used in the charge transporting layer, any ingredients compatible with the charge transporting substance can be used, including polycarbonate and copolycarbonate, polyarylate, polyvinyl butyral, polyamide, polyester, polyketone, epoxy resin, polyurethane, polyvinyl ketone, polystyrene, polyacrylamide, phenol resin, phenoxy resin, polysulfone resin, and copolymer resin of these ingredients. The ingredients just cited are used alone or in admixture of two or more thereof. In particular, polystyrene, polycarbonate, copolycarbonate, polyarylate, and polyester are preferable, each having a volume resistivity of $10^{13}\Omega$ or more and being excellent in film-forming property and potential characteristic.

The coating liquid for charge transporting layer is prepared by dissolving the above-stated binder in a solvent and then dissolving the charge transporting substance in the solvent. The usable solvent includes, for example: alcohols such as methanol and ethanol; ketones such as acetone, methyl ethyl ketone, and cyclohexanone; ethers such as ethyl ether and tetrahydrofuran; halogenated aliphatic hydrocarbons such as chloroform, dichloroethane, and dichloromethane; and aromatic hydrocarbons such as benzene, chlorobenzene, and toluene. In particular, tetrahydrofuran is desired. The ratio of the charge transporting substances in the charge transporting layer is preferably 30% to 80% by weight.

[Substrate]

Materials usable for the conductive cylindrical substrate 1 are, for example, metals such as aluminum, copper, brass, zinc, nickel, stainless-steel, chrome, molybdenum, vanadium, indium, titanium, gold, and platinum, or alloy of these metals, aluminum alloy, or tin oxide. Gold, indium oxide, or other ingredients may be deposited on or applied to a film which is then wound on paper or plastic. These materials are finished in a cylindrical form to be then used.

[Coating and Drying Conditions]

The undercoat layer is formed in a manner that the prepared coating liquid is applied onto an outer circumferential surface of the cylindrical substrate 1 according to the dip coating method by use of the layer forming apparatus 30 shown in FIG. 1, followed by drying through a drying equipment (not shown). The conditions for drying the coated film are set in a range from 40° C. to 130° C. and in a range from 10 minutes to 2 hours so that the solvent in use will not remain.

The pull-up speed upon forming the undercoat layer is set according to the viscosity and density of the coating liquid for undercoat layer and the thickness of the coated layer, and preferably set at 0.1 to 5.0 cm/s. The dipping speed is preferably 1.2 to 10 times as high as the pull-up speed. The film thickness of the undercoat layer is set around in a range of 0.1 to 5 μm.

As in the case of the undercoat layer, the charge generating layer is formed in a manner that the coating liquid for charge generating layer is prepared and applied, by use of the layer forming apparatus 30 shown in FIG. 1, to the cylindrical substrate 1 on which the undercoat layer has been formed by the dip coating method, followed by drying through a drying equipment (not shown). The conditions for drying the coated film are set in a range from 40° C. to 130° C. and in a range from 10 minutes to 2 hours so that the solvent in use will not remain.

The pull-up speed upon forming the charge generating layer is set according to the viscosity and density of the coating liquid for charge generating layer and the thickness of the coated layer, and preferably set at 0.1 to 5.0 cm/s. The dipping speed is preferably 1.2 to 10 times as high as the pull-up speed. The film thickness of the charge generating layer is set around in a range of 0.05 to 5 μm and preferably in a range of 0.1 to 2.5 μm.

As in the case of the undercoat layer and the charge generating layer, the charge transporting layer is formed in a manner that the coating liquid for charge transporting layer is prepared and applied, by use of the layer forming apparatus 30 shown in FIG. 1, to the cylindrical substrate 1 on which the undercoat layer and the charge generating layer have been formed by the dip coating method, followed by drying through a drying equipment (not shown). The conditions for drying the coated film are set in a range from 40° C. to 130° C. and in a range from 10 minutes to 2 hours so that the solvent in use will not remain.

The pull-up speed upon forming the charge transporting layer is set according to the viscosity and density of the coating liquid for charge transporting layer and the thickness of the coated layer, and preferably set at 0.1 to 5.0 cm/s. The dipping speed is preferably 1.2 to 10 times as high as the pull-up speed. The film thickness of the charge transporting layer is set around in a range of 10 to 50 μm and preferably in a range of 15 to 40 μm.

EXAMPLES

Hereinafter, the example embodiment presented herein will be described more in detail with reference to Examples and Comparative examples, neither of which limit the example embodiment in any way.

An aluminum tube having a length of 340 mm and an outer diameter of 65 mm was used as the cylindrical substrate 1. There was used the layer forming apparatus 30 shown in FIGS. 2 to 5, which was designed to obtain 16 photoreceptors at one time and in which the dipping cylinder 7 was 95 mm in diameter and the dispersion plate 20 had 8 coating liquid discharge ports 19 shown in FIG. 4, each having a diameter of 8 mm. While the amount of liquid supply was varied to a range from 2 to 60 L/min, the generation of bubble 40 was detected.

(Test 1)

The coating liquid for undercoat layer having the following composition was used. The number of bubbles generated in the overflowing liquid around an outlet of the dipping cylinder 7 was visually checked and counted (observation time: 60 seconds).

Solvent: 41 parts by weight of methanol and 41 parts by weight of 1-3 dioxolan

Additive: 9 parts by weight of titanium oxide (TTO-D-1 manufactured by Ishihara Sangyo Kaisha, Ltd.)

Resin: 9 parts by weight of copolymer nylon (CM8000 manufactured by Toray Industries Inc.)

Liquid viscosity: 7 mPa·s

The results are represented in the following table 1 in which a blank indicates that no experiment was conducted.

TABLE 1

| | | Distance between discharge port and lower end port of dipping cylinder (mm) | | | | |
|---|---|---|---|---|---|---|
| | | 0 | 1 | 3 | 5 | 10 |
| Supplied amount of liquid (L/min) | 2 | 0 bubble | 0 bubble | | | |
| | 5 | 0 bubble | 0 bubble | | | |
| | 10 | 0 bubble | 0 bubble | | | |
| | 20 | 0 bubble | 0 bubble | | | |
| | 30 | 1 bubble | 0 bubble | 0 bubble | | |
| | 40 | 1 bubble | 0 bubble | 0 bubble | | |
| | 50 | 4 bubbles | 1 bubble | 0 bubble | 0 bubble | |
| | 60 | 7 bubbles | 2 bubbles | 0 bubble | 0 bubble | |

(Test 2)

The coating liquid for charge generating layer having the following composition was used. As in the above case, the number of bubbles generated in the overflowing liquid around the outlet of the dipping cylinder 7 was visually checked and counted (observation time: 60 seconds).

Solvent: 97 parts by weight of THF (tetrahydrofuran)

Charge generating material: 2 parts by weight of X-type metal-free phthalocyanine (manufactured by Toyo Ink MFG. Co., Ltd.)

Resin: 1 part by weight of polyvinyl butyral resin (BX-1 manufactured by Sekisui Chemical Co., Ltd)

Liquid viscosity: 2.5 mPa·s

The results are represented in the following table 2 in which a blank indicates that no experiment was conducted.

TABLE 2

| | | Distance between discharge port and lower end port of dipping cylinder (mm) | | | | |
|---|---|---|---|---|---|---|
| | | 0 | 1 | 3 | 5 | 10 |
| Supplied amount of liquid (L/min) | 2 | 0 bubble | 0 bubble | | | |
| | 5 | 0 bubble | 0 bubble | | | |
| | 10 | 0 bubble | 0 bubble | | | |
| | 20 | 0 bubble | 0 bubble | | | |
| | 30 | 0 bubble | 0 bubble | | | |
| | 40 | 0 bubble | 0 bubble | | | |
| | 50 | 1 bubble | 0 bubble | 0 bubble | | |
| | 60 | 2 bubbles | 0 bubble | 0 bubble | | |

(Test 3)

The coating liquid for charge transporting layer having the following composition was used. As in the above cases, the number of bubbles generated in the overflowing liquid around the outlet of the dipping cylinder 7 was visually checked and counted (observation time: 60 seconds).

Solvent: 80 parts by weight of THF (tetrahydrofuran)

Charge transporting material: 12 parts by weight of a butadiene compound (having the following structure)

Resin: 14 parts by weight of polycarbonate resin (Z200 manufactured by Mitsubishi Gas Chemical Company, Inc.)

Additive: 0.2 parts by weight of antioxidant (2,6-t-butyl-4 methylphenol)

Liquid viscosity: 400 mPa·s

Structural Formula A

Figure 9:
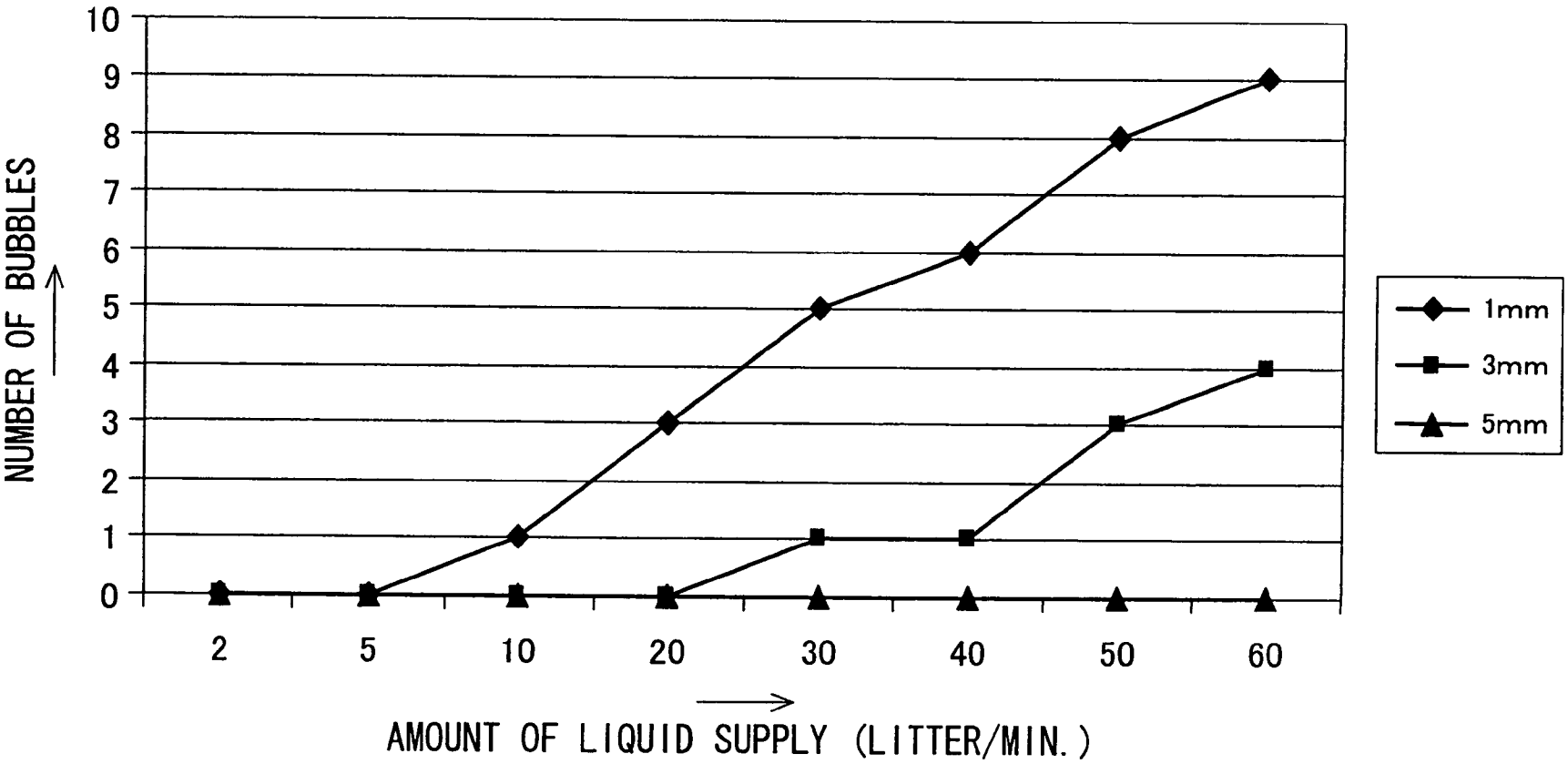
FIG. 9 is a graph showing a result represented in Table 3.

The results are represented in the following table 3 in which a blank indicates that no experiment was conducted. The results shown in table 3 are represented in graph form in FIG. 9.

TABLE 3

| | | Distance between discharge port and lower end port of dipping cylinder (mm) | | | | |
|---|---|---|---|---|---|---|
| | | 0 | 1 | 3 | 5 | 10 |
| Supplied amount of liquid (L/min) | 2 | 5 bubbles | 0 bubble | 0 bubble | | |
| | 5 | 7 bubbles | 0 bubble | 0 bubble | | |
| | 10 | many | 1 bubble | 0 bubble | 0 bubble | |
| | 20 | many | 3 bubbles | 0 bubble | 0 bubble | |
| | 30 | many | 5 bubbles | 1 bubble | 0 bubble | 0 bubble |
| | 40 | many | 6 bubbles | 1 bubble | 0 bubble | 0 bubble |
| | 50 | many | 8 bubbles | 3 bubbles | 0 bubble | 0 bubble |
| | 60 | many | 9 bubbles | 4 bubbles | 0 bubble | 0 bubble |

[Evaluation on Photoreceptor]

1) Visual Evaluation

The photoreceptor was visually checked by use of UV light, with attention drawn to the cylindrical substrate 1 on which the photosensitive layer consisting of the undercoat layer, the charge generating layer, and the charge transporting layer had been formed. The number of bubbles 40 counted in the coating liquid corresponded to the number of defects recognized in the coated film.

2) Image Evaluation

Among the photoreceptors formed by, on the cylindrical substrate 1, applying the charge transporting layer onto the undercoat layer and charge generating layer in which no bubbles 40 were recognized, the photoreceptors having 0, 1, 3, 5, and 8 coating detects were selected. Such photoreceptors were mounted on a commercially-available image forming apparatus that is, to be specific, a digital full color multifunction printer: ARC-150 (trade name) manufactured by Sharp Corporation. By using an image forming apparatus thus obtained, a halftone image was printed overall on an A3-sized recording sheet. An image defect of black or white spot appeared in a part of the image, corresponding to the visually recognized bubble 40.

Herein, the example indicates an electrophotographic photoreceptor containing no film defects while the comparative example indicates an electrophotographic photoreceptor having one or more film defects, among the electrophotographic photoreceptors manufactured by using the above-stated layer forming apparatus 30.

TABLE 4

| Example | Number of film defects | Supplied amount of liquid (L/min) | Distance between discharge port and lower end port of dipping cylinder (mm) |
|---|---|---|---|
| Example | 0 defect | 60 | 5 |
| Comparative example 1 | 1 defect | 40 | 3 |
| Comparative example 2 | 3 defects | 50 | 3 |
| Comparative example 3 | 5 defects | 30 | 1 |
| Comparative example 4 | 8 defects | 50 | 1 |

According to the example embodiment, in the layer forming apparatus 30 for electrophotographic photoreceptor, which is composed of the coating tank having: the bath 21 for storing the coating liquid; the dipping cylinder 7 having the lower end port thereof dipped in the coating liquid; and the coating liquid discharge port 19 for discharging the coating liquid supplied from a liquid-supply pump 13 to the bath 21, and which forms at least one layer of the photosensitive layers of the electrophotographic photoreceptor through the dip coating method, the lower end port of the dipping cylinder 7 is distanced away in the horizontal direction from the coating liquid discharge port 19, and the coating liquid discharge port 19 is disposed above the lower end port of the dipping cylinder 7. Thus, the bubble 40 does not move into the dipping cylinder 7 even when the bubble 40 is generated in the coating liquid, resulting in a fine photoreceptor which is free from film defects. The adoption of such an electrophotographic photoreceptor in an electrophotographic device causes no image defects to appear, allowing a high-quality image to be procured.

According to the example embodiment, the coating liquid discharge port 19 and the lower end port of the dipping cylinder 7 are distanced away from each other by 5 mm or longer when seen in the vertical direction and therefore, even when the coating liquid containing the bubble 40 is supplied from the coating liquid discharge port 19, the bubble 40 stays outside of the dipping cylinder 7 and does not move into the dipping cylinder 7 by virtue of the difference of 5 mm or more in height between the coating liquid discharge port 19 and the lower end port of the dipping cylinder 7. This makes it possible to obtain a favorable photosensitive layer that no bubbles 40 are contained in the cylindrical substrate 1 which is to be coated with the coating liquid.

According to the example embodiment, the layer forming apparatus 30 further comprises: the coating liquid supply port 18 for supplying the coating liquid to the coating liquid discharge port 19; and the dispersion plate 20 which is platy and disposed above the coating liquid supply port 18 and in which the coating liquid discharge port 19 is formed, and therefore the coating liquid supplied from the coating liquid supply port 18 can be thus dispersed in a radial pattern. Thus, even in the case where a large number of the coating liquid discharge ports 19 are formed, the coating liquid is dispersed to be discharged from the respective coating liquid discharge ports 19. This enables to adapt the layer forming apparatus 30 to obtain a plurality of photoreceptors at one time through the coating in the dipping cylinders 7.

According to the example embodiment, the dispersion plate 20 is provided with the liquid-dispersing convex portion 36 having a tapered shape at a position located above the coating liquid supply port 18 so that the coating liquid can be dispersed more smoothly. Moreover, a larger area for the coating liquid to collide with decreases the mutual collision of liquid which causes the bubble 40, resulting in suppressed generation of the bubble 40.

According to the example embodiment, the coating tank is composed of the lower tank 24 having the bath and the upper tank 25 positioned above the lower tank 24, and the lower tank 24 and the upper tank 25 are separable. This can lead not only facilitation of cleaning and maintenance but also reduction in length of working hours relating to the exchange of the coating liquid.

According to the example embodiment, outside the dipping cylinder 7, the bath 21 is formed inside the coating tank, the upper part of the bath 21 is formed into a tapered shape, and the apex of the bath 21 is provided with the bubble-removing tube 23 for discharging a bubble so that the bubble 40 can move upward along a sloping surface of the upper tapered portion to be then discharged from the bubble-removing tube 23 for certain. Moreover, no accumulation of bubbles 40 will prevent the bubble 40 from moving into the dipping cylinder 7.

According to the example embodiment, it is possible to easily remove the bubble 40 also contained in the coating liquid for charge transporting layer in which the bubble 40 is more liable to be generated compared to the coating liquid for undercoat layer and the coating liquid for charge generating layer.

According to the example embodiment, the layer forming system 41 is composed of the layer forming apparatus 30 for electrophotographic photoreceptor and the circulation device 37 having at least: the return piping 15 and supply piping 16 for circulating the coating liquid stored in the bath 21; and the liquid-supply pump 13 for supplying the coating liquid to the return piping 15 and supply piping 16, with the result that the photosensitive layer of the electrophotographic photoreceptor containing no bubbles 40 can be prepared.

The above tests and the comparison between the example and the comparative examples reveal that a fine photoreceptor which is free from film defects can be manufactured by preventing the bubble 40 from actually moving into the dipping cylinder 7 even when the circulating coating liquid contains the bubble 40.

As described above, when the layer forming apparatus 30 of the invention was used, the bubble 40 was prevented from being attached to the cylindrical substrate 1, thus allowing the manufacture of an excellent photoreceptor which is free from film defects.

Figure 10B:
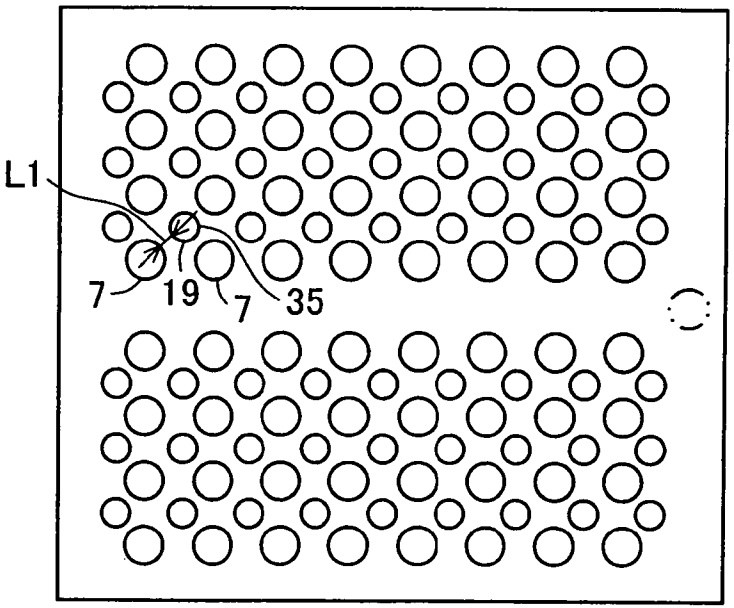
FIG. 10B is a sectional view showing a layer forming apparatus according to a third embodiment.
Figure 10A:
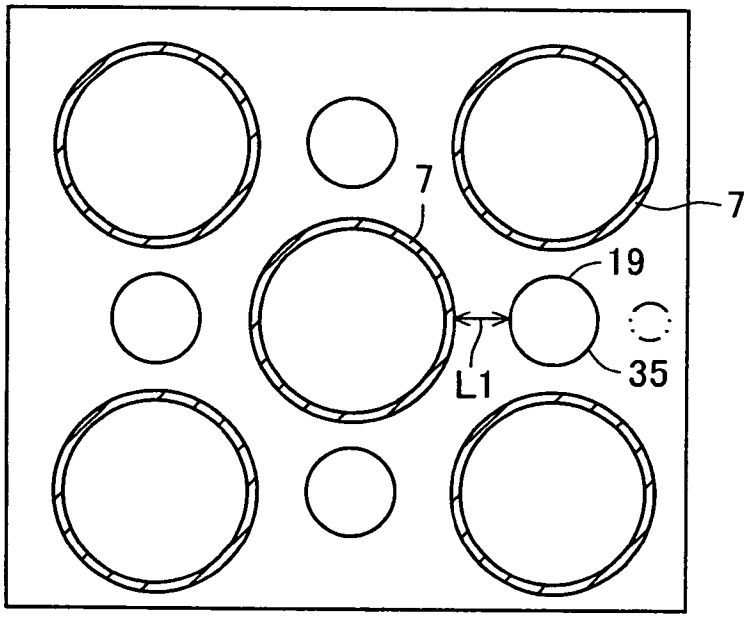
FIG. 10A is a sectional view showing a layer forming apparatus according to a second embodiment.

Note that although the cylindrical substrate 1 having an outer diameter of 65 mm was used in the above example, the cylindrical substrate 1 having an outer diameter of 30 mm to 120 mm is applicable when the upper layer or the dispersion plate is also modified as shown in FIGS. 10A and 10B.

Figure 11B:
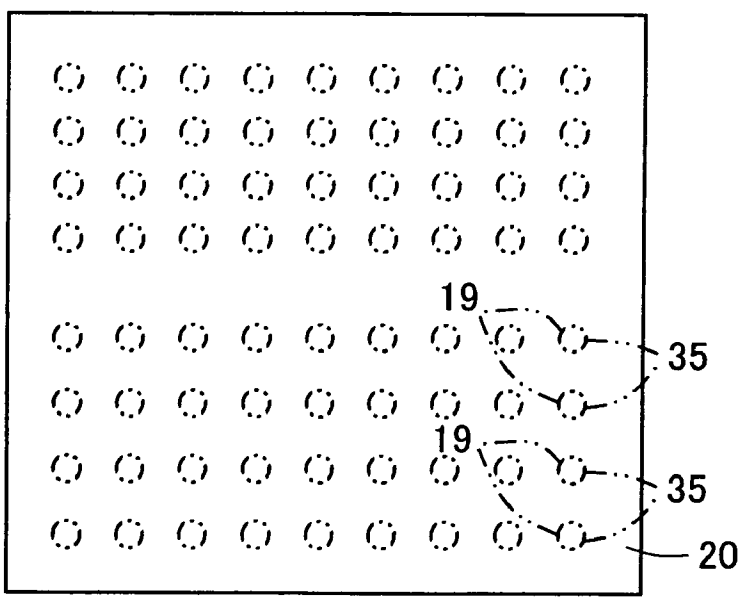
FIG. 11B is a plan view showing a dispersion plate used in the layer forming apparatus according to the third embodiment.
Figure 11A:
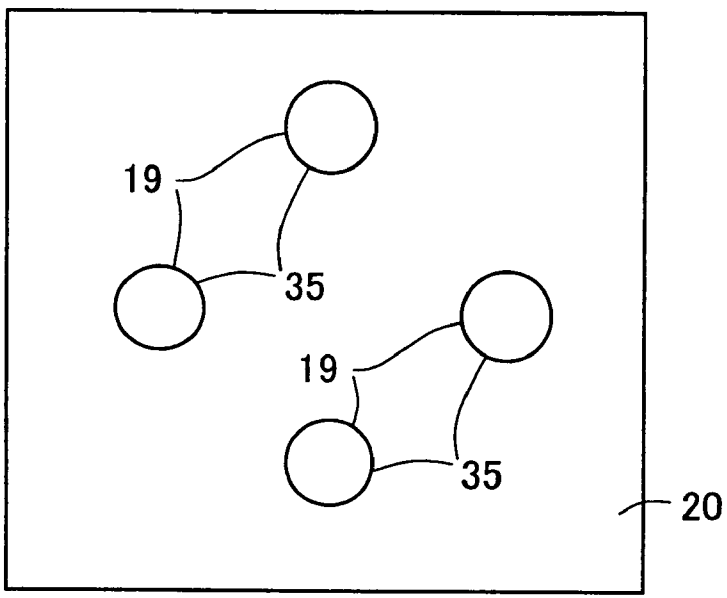
FIG. 11A is a plan view showing a dispersion plate used in the layer forming apparatus according to the second embodiment.

FIG. 10A is a sectional view showing the layer forming apparatus 30A according to a second embodiment of the invention, and FIG. 10B is a sectional view showing the layer forming apparatus 30B according to a third embodiment of the invention. FIG. 11A is a plan view showing a dispersion plate 20A used in the layer forming apparatus 30A according to the second embodiment of the invention, and FIG. 11B is a plan view showing a dispersion plate 20B used in the layer forming apparatus 30B according to the third embodiment of the invention. The layer forming apparatus 30A and the layer forming apparatus 30B are different from the layer forming apparatus 30 only in the number of the provided dipping cylinders 7 and the number of the provided coating liquid discharge ports 19.

To be specific, the layer forming apparatus 30A has five dipping cylinders 7 among which four dipping cylinders 7 have axes thereof disposed at opposing corners of a square and one remaining dipping cylinder 7 has an axis thereof disposed at the intersection of diagonal lines connecting the opposing corners. In the dispersion plate 20 are formed four coating liquid discharge ports 19 of which each axis is disposed on a straight line connecting the axes of the dipping cylinders 7 adjacent to the coating liquid discharge port 19. The coating liquid discharge port 19 is thus disposed between the dipping cylinders 7.

The layer forming apparatus 30B has 64-dipping cylinders 7 which are disposed in 8×8 matrix. In the dispersion plate 20 are formed 54-coating liquid discharge ports 19. The respective coating liquid discharge ports 19 are disposed in 6×9 matrix. Among these, 42-coating liquid discharge ports 19 each has axis thereof disposed on a straight line connecting the axes of the dipping cylinders 7 adjacent to the coating liquid discharge port 19. Each of the 42-coating liquid discharge ports 19 is thus disposed between the dipping cylinders 7.

The example embodiment presented herein may be embodied in other specific forms without departing from the spirit or essential characteristics thereof. The present embodiments are therefore to be considered in all respects as illustrative and not restrictive, the scope of the embodiments being indicated by the appended claims rather than by the foregoing description and all changes which come within the meaning and the range of equivalency of the claims are therefore intended to be embraced therein.

What is claimed is:

1. A layer forming apparatus for electrophotographic photoreceptor, comprising: a coating tank forming a bath for storing a coating liquid; a dipping cylinder having a lower end port thereof dipped in the coating liquid, wherein said lower end port is above the bottom of said coating tank; and a coating liquid discharge port for discharging the coating liquid supplied from a liquid-supply pump to the bath, wherein at least one layer of photosensitive layers of an electrophotographic photoreceptor is formed by a dip coating method, wherein a lower end port of the dipping cylinder is distanced away in a horizontal direction from the coating liquid discharge port, and the coating liquid discharge port is disposed above the lower end port of the dipping cylinder, and wherein the coating liquid discharge port is in the coating liquid.

2. The layer forming apparatus of claim 1, wherein a distance in a vertical direction between the coating liquid discharge port and the lower end port of the dipping cylinder is 5 mm or more.

3. The layer forming apparatus of claim 2, further comprising:

a coating liquid supply port for supplying the coating liquid to the coating liquid discharge port; and a dispersion plate which is flat and disposed above the coating liquid supply port and in which the coating liquid discharge port is formed.

4. The layer forming apparatus of claim 3, wherein the dispersion plate is provided with a liquid-dispersing convex portion having a tapered shape at a position located above the coating liquid supply port.

5. The layer forming apparatus of claim 1, wherein the coating tank comprises a lower tank having the bath and an upper tank positioned above the lower tank, the lower tank and the upper tank being separable.

6. The layer forming apparatus of claim 1, wherein an upper part of the bath is formed into a tapered shape, and an apex of the bath is provided with a bubble-removing tube for discharging a bubble.

7. The layer forming apparatus of claim 1, wherein the coating liquid is a coating liquid for charge transporting layer.

8. A layer forming system comprising:

the layer forming apparatus for electrophotographic photoreceptor of claim 1; and a circulation device having at least a circulation passage for circulating a coating liquid stored in a bath, and a liquid-supply pump for supplying the coating liquid through the circulation passage.

* * * * *